US006848949B2

(12) United States Patent
Mullaney et al.

(10) Patent No.: US 6,848,949 B2
(45) Date of Patent: Feb. 1, 2005

(54) SEALANT-FILLED CONNECTOR ASSEMBLIES FOR USE WITH CONNECTOR PLUGS AND METHODS FOR FORMING THE SAME

(75) Inventors: Julian S. Mullaney, Raleigh, NC (US); David Ray Radliff, Holly Springs, NC (US); James A. Croce, Sr., Angier, NC (US)

(73) Assignee: Tyco Electronics Corporation, Middletown, PA (US)

( * ) Notice: Subject to any disclaimer, the term of this patent is extended or adjusted under 35 U.S.C. 154(b) by 371 days.

(21) Appl. No.: 10/127,354

(22) Filed: Apr. 22, 2002

(65) Prior Publication Data

US 2003/0199201 A1 Oct. 23, 2003

(51) Int. Cl.[7] ..... H01R 24/00
(52) U.S. Cl. ..... 439/676; 439/521
(58) Field of Search ..... 439/521, 519, 439/676, 634, 144, 936, 954

(56) References Cited

U.S. PATENT DOCUMENTS

| | | | | |
|---|---|---|---|---|
| 4,634,207 A | | 1/1987 | Debbaut | 339/116 C |
| 5,111,497 A | | 5/1992 | Bliven et al. | 379/27 |
| 5,195,125 A | | 3/1993 | Bliven et al. | 379/29 |
| 5,246,383 A | | 9/1993 | Shimirak et al. | 439/521 |
| 5,358,430 A | | 10/1994 | Bonvallat et al. | 439/676 |
| 5,359,654 A | | 10/1994 | Jensen et al. | 379/397 |
| 5,376,019 A | | 12/1994 | Shimirak et al. | 439/521 |
| 5,404,401 A | | 4/1995 | Bliven et al. | 379/442 |
| 5,406,702 A | | 4/1995 | Shimirak et al. | 29/883 |
| 5,427,547 A | | 6/1995 | Shimirak et al. | 439/521 |
| 5,518,415 A | | 5/1996 | Sano | 439/204 |
| 5,562,491 A | | 10/1996 | Shimirak et al. | 439/521 |
| 5,595,504 A | * | 1/1997 | Muller | 439/521 |
| 5,598,455 A | | 1/1997 | Bliven et al. | 379/27 |
| 5,601,460 A | | 2/1997 | Shimirak et al. | 439/936 |
| 5,626,497 A | * | 5/1997 | Bouchan et al. | 439/676 |
| 5,685,742 A | * | 11/1997 | Reynolds | 439/676 |
| 5,934,934 A | * | 8/1999 | Ward | 439/521 |
| 5,975,945 A | * | 11/1999 | Daoud | 439/519 |
| 6,028,928 A | | 2/2000 | Mullaney et al. | 379/399 |
| 6,210,235 B1 | * | 4/2001 | Wu | 439/676 |
| 6,224,419 B1 | * | 5/2001 | Tucker et al. | 439/521 |

FOREIGN PATENT DOCUMENTS

| | | | |
|---|---|---|---|
| EP | 0874418 | 10/1998 | H01R/13/52 |

* cited by examiner

*Primary Examiner*—Hae Moon Hyeon
(74) *Attorney, Agent, or Firm*—Myers Bigel Sibley & Sajovec

(57) ABSTRACT

A sealant-filled connector assembly for use with a connector plug includes a connector housing including a unitary body portion defining a body cavity and at least one conductor passage extending through the unitary body portion and communicating with the body cavity. The connector housing defines a connector opening communicating with the body cavity. The connector opening is adapted to receive the connector plug. An electrical conductor extends through the at least one conductor passage and has a contact portion disposed in the body cavity. An environmental sealant is disposed in the body cavity up to a sealant fill level and at least partially covering each the contact portion. The unitary body portion is devoid of openings other than the at least one conductor passage up to at least the sealant fill level.

56 Claims, 9 Drawing Sheets

SEALANT-FILLED CONNECTOR ASSEMBLIES FOR USE WITH CONNECTOR PLUGS AND METHODS FOR FORMING THE SAME

FIELD OF THE INVENTION

The present invention relates to electrical connectors and, more particularly, to a connector assembly for use with a connector plug.

BACKGROUND OF THE INVENTION

Telephone line connections at subscriber locations are commonly made with an RJ-type of plug and socket connector such as an RJ-11 or RJ-45. These connectors are exemplary of electrical connections susceptible to failure from oxidation, corrosion, humidity, salt, and the like, especially in the presence of a live voltage on the conductors within the connector.

For example, it is sometimes difficult to establish and maintain an adequate environmental seal in a removable male RJ-type plug, particularly when wires lead from the male RJ-type plug. Accordingly, moisture and other environmental contaminants are allowed to enter such plugs, sometimes resulting in corrosion and/or failure of the connection of the tip and ring connections in the socket/plug combination. RJ-type sockets are likewise subject to moisture contamination and corrosion, as well as being subject to dust buildup. In hot, humid environments, such as in Florida and along the Gulf Coast of Texas, failure can occur within several months of installation. Servicing these failures is costly for the consumer or the telephone company.

Problems may also arise in connection with test ports for customer telecommunications equipment such as remote terminals at customer facilities and the like. It is often desirable to provide an RJ-type connector of the type well known to those of skill in the art, or other such connector, at an external location at a subscriber facility, such as a junction box leading to a house, or a remote terminal of the type described above. Access may be provided by installing a female RJ-type socket which is normally connected to a male RJ-type plug. The tip and ring wires (among other wires in some cases) lead from the female RJ-type socket, and connect to tip and ring connections in the male RJ-type plug, thereafter leading into the subscriber facility. When it is desired to connect test equipment to the RJ-type female socket, the plug may be removed, and another male RJ-type may be inserted into the female socket, thereby providing tip and ring connections for the test equipment. Even though the equipment may be contained in a protective housing, such arrangements are sometimes subject to much of the same moisture/corrosion degradation as described above.

A similar problem may be experienced when RJ-type connectors are employed to connect networked computer stations for data communication. Commonly, such RJ-type connectors are used in components such as servers situated in closets. The temperatures and humidities present in the closets may vary widely and tend to degrade the connections or short circuit adjacent contacts.

Plug and socket type sealant-filled electrical connectors intended to overcome or reduce the above-described problems have been proposed. See, e.g., the disclosures of U.S. Pat. Nos. 5,562,491 and 5,601,460, each to Shimirak et al.

SUMMARY OF THE INVENTION

According to embodiments of the present invention, a sealant-filled connector assembly for use with a connector plug includes a connector housing including a unitary body portion defining a body cavity and at least one conductor passage extending through the unitary body portion and communicating with the body cavity. The connector housing defines a connector opening communicating with the body cavity. The connector opening is adapted to receive the connector plug. An electrical conductor extends through the at least one conductor passage and has a contact portion disposed in the body cavity. An environmental sealant is disposed in the body cavity up to a sealant fill level and at least partially covers each contact portion. The unitary body portion is devoid of openings other than the at least one conductor passage up to at least the sealant fill level.

According to method embodiments of the present invention, a method for forming a sealant-filled connector assembly for use with a connector plug includes providing a connector housing including a unitary body portion defining a body cavity and at least one conductor passage extending through the unitary body portion and communicating with the body cavity. The connector housing defines a connector opening communicating with the body cavity. The connector opening is adapted to receive the connector plug. A respective electrically conductive conductor is mounted in the at least one conductor passage such that the conductor has a contact portion disposed in the body cavity. An uncured sealant material is introduced into the body cavity up to a sealant fill level such that each contact portion is at least partially covered by the uncured sealant material. The sealant material is cured to form an environmental sealant in the body cavity. The unitary body portion is devoid of openings other than the at least one conductor passage up to at least the sealant fill level.

According to further method embodiments of the present invention, a method for forming a sealant-filled connector assembly for use with a connector plug includes mounting a connector housing on a substrate. The connector housing defines a body cavity and a connector opening communicating with the body cavity and adapted to receive the connector plug. A plurality of contact portions are provided in the body cavity. An uncured sealant material is introduced into the body cavity through the body opening such that the sealant material is retained in the body cavity and the body cavity is filled with the sealant material to a level sufficient to at least partially cover the contact portions. The sealant material is cured to form an environmental sealant in the body cavity. The substrate is maintained in a substantially horizontal orientation and the connector opening is disposed at an oblique angle relative to horizontal during the step of introducing the uncured sealant material.

According to further embodiments of the present invention, a connector assembly for use with a connector plug includes a connector housing defining a body cavity and a connector opening communicating with the body cavity. The connector opening is adapted to receive the connector plug. At least one electrical contact portion is disposed in the body cavity. The connector housing is adapted to be mounted on a planar surface of a substrate. The connector opening is disposed at an oblique angle relative to the planar surface when the connector housing is mounted on the planar surface. The connector plug is an RJ-type connector plug.

According to further embodiments of the present invention, a connector assembly for use with a connector plug includes a body member defining a body cavity. First and second electrical contact portions extend across the body cavity. A cover member is mounted on the body member, the cover member defining a cover opening adapted to receive the connector plug and communicating with the body cavity. The cover member further defines at least one recess therein. An electrically conductive shorting bar is press-fit into the recess such that the shorting bar is retained in the cover member and engages each of the first and second contact portions to electrically short circuit the first and second contact portions when the cover member is mounted on the body member.

According to further method embodiments of the present invention, a method for forming a connector assembly for use with a connector plug includes press-fitting an electrically conductive shorting bar into a recess in a cover member such that the shorting bar is retained in the cover member. The cover member is mounted on a body member such that the shorting bar engages each of first and second contact portions disposed in a body cavity defined in the body member to thereby electrically short circuit the first and second contact portions.

According to further embodiments of the present invention, a connector assembly for use with a connector plug and a substrate having first and second mounting holes therein includes a body member defining a body cavity adapted to receive the connector plug. At least one electrical contact portion is disposed in the body cavity. A cover member is removably mounted on the body member, the cover member defining a cover opening adapted to receive the connector plug and communicating with the body cavity. A first mounting structure integral with the body member is configured to engage the first mounting hole of the substrate. A second mounting structure integral with the cover member is configured to engage the second mounting hole of the substrate such that the cover member is thereby secured to the substrate.

According to further method embodiments of the present invention, a method for forming a sealant-filled connector assembly for use with a connector plug includes mounting a cover member on a body member to form a connector housing. The body member defines a body cavity adapted to receive the connector plug. The cover member defines a cover opening adapted to receive the connector plug and communicating with the body cavity. At least one electrical contact portion is provided in the body cavity. The connector housing is mounted on a substrate such that a first mounting structure integral with the body member engages a first mounting hole in the substrate and a second mounting structure integral with the cover member interlocks with a second mounting hole in the substrate.

Objects of the present invention will be appreciated by those of ordinary skill in the art from a reading of the figures and the detailed description of the preferred embodiments which follow, such description being merely illustrative of the present invention.

DETAILED DESCRIPTION OF THE PREFERRED EMBODIMENTS

Figure 2:
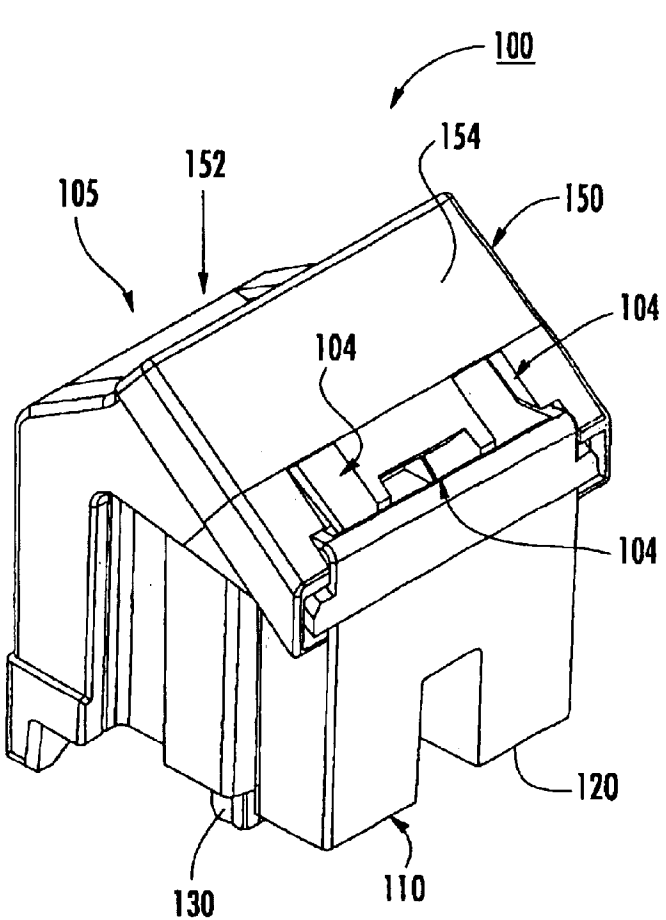
FIG. 2 is a rear perspective view of the connector assembly of FIG. 1.
Figure 1:
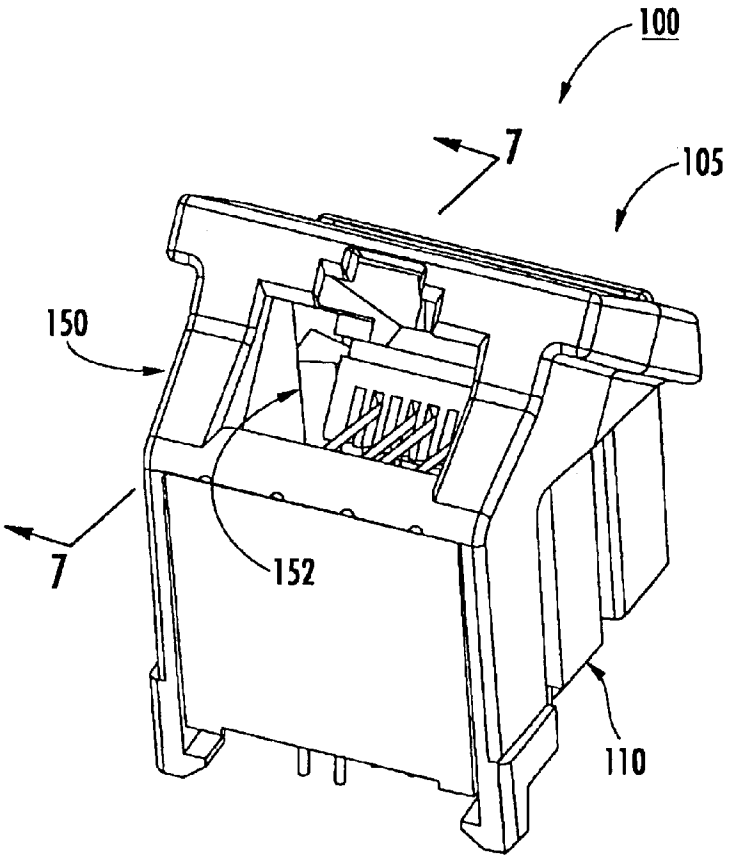
FIG. 1 is a front perspective view of a connector assembly according to embodiments of the present invention.

The present invention now will be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the relative sizes of regions may be exaggerated for clarity. It will be understood that when an element such as a layer, region or substrate is referred to as being "on" another element, it can be directly on the other element or intervening elements may also be present. In contrast, when an element is referred to as being "directly on" another element, there are no intervening elements present.

Figure 14:
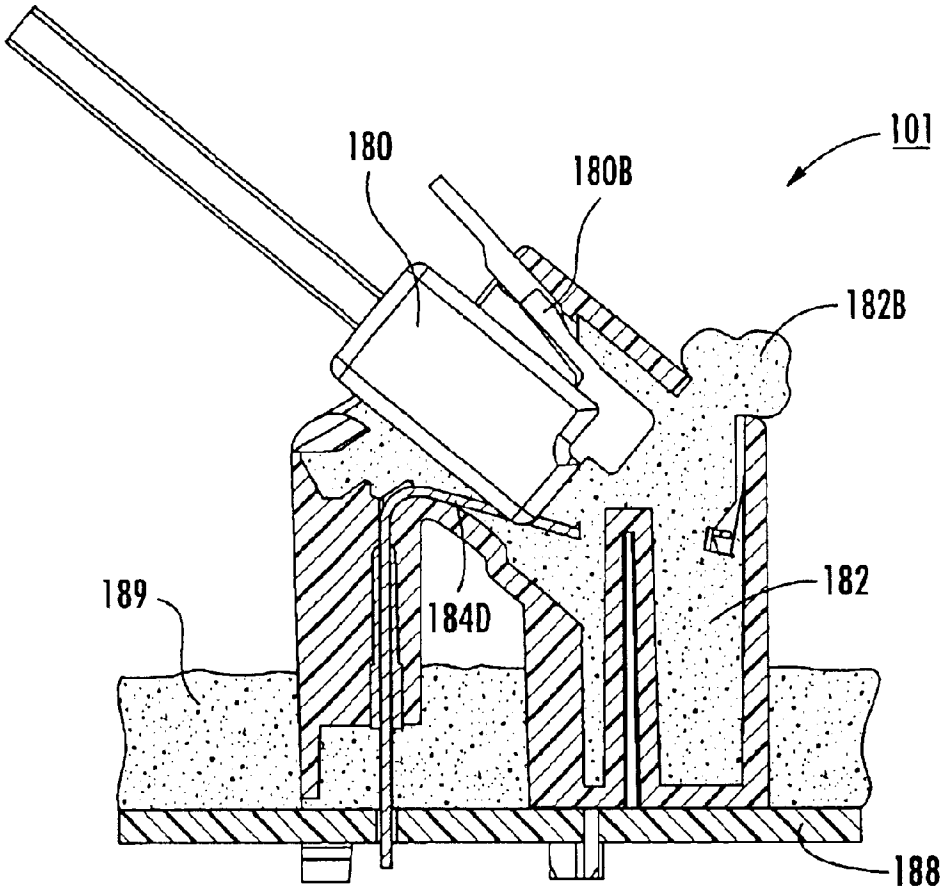
FIG. 14 is a cross-sectional view of the sealant-filled connector assembly and connector plug of FIG. 13, wherein the connector plug is inserted into the sealant-filled connector assembly.

With reference to FIGS. 1–5, 7 and 10, a connector assembly 100 (which may also be referred to as a socket or jack) according to embodiments of the present invention is shown therein. The connector assembly 100 is adapted for use with an electrical connector plug 180 as shown in FIG. 14. Typically, the plug 180 will have an associated electrical cable 180A. Preferably, the connector assembly 100 is adapted for operative use with an RJ-type plug and, more preferably, with an RJ-11 and/or RJ-45-type plug. According to certain preferred embodiments, the connector assembly 100 is filled with a sealant material 182 to form a sealant-filled jack 101 as shown in FIG. 14. According to certain preferred embodiments, the connector assembly 100 is adapted to be mounted on a substrate such as a circuit board 188 as shown in FIG. 14. According to certain preferred embodiments, the connector assembly 100 may further include an environmental sealant material 189 as also shown in FIG. 14.

Figure 4:
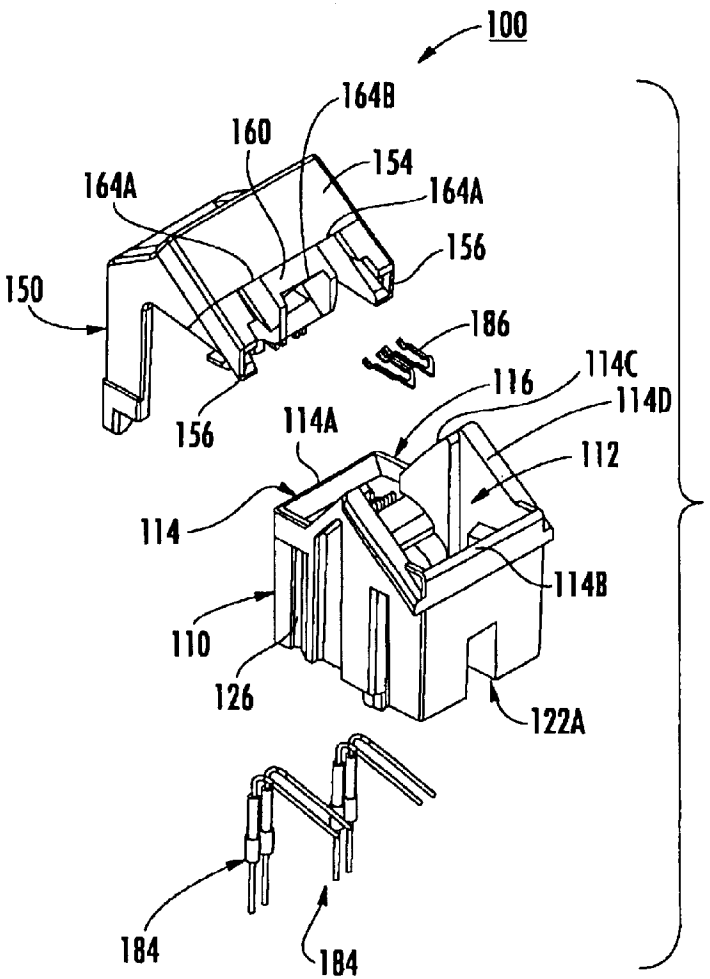
FIG. 4 is a rear, exploded, perspective view of the connector assembly of FIG. 1.
Figure 6:
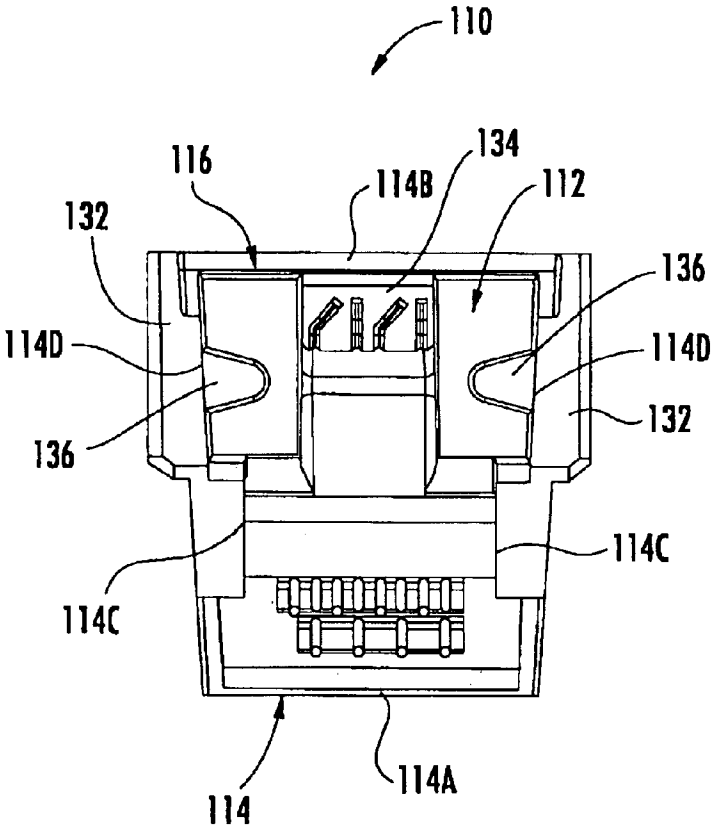
FIG. 6 is a top plan view of a body member forming a part of the connector assembly of FIG. 1.
Figure 7:
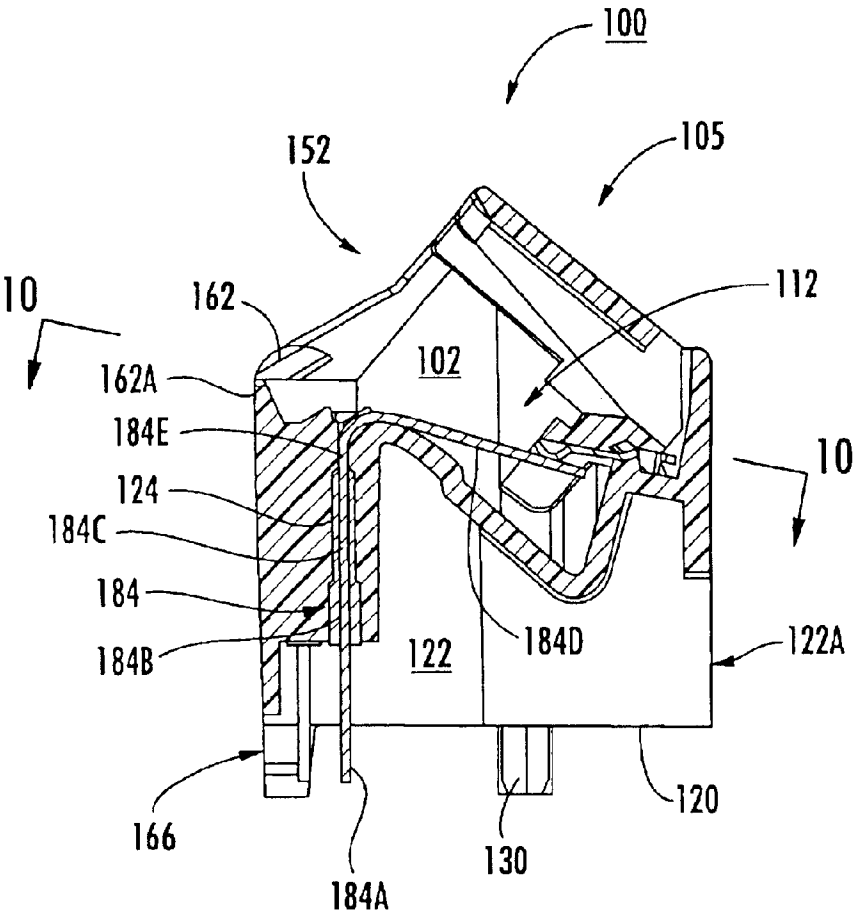
FIG. 7 is a cross-sectional view of the connector assembly of FIG. 1 taken along the line 7—7 of FIG. 1.

Referring to the connector assembly 100 in more detail, the connector assembly 100 includes a base or body member 110 and a cover member 150. The body member 110 and the cover member 150 cooperatively form a connector housing 105. The body member 110 defines a cavity 112 (FIGS. 4, 6 and 7). The body member 110 and the cover member 150 together define an overall connector assembly cavity 102 (FIG. 7). The cover member 150 defines an opening 152 which serves as a plug opening for the connector assembly 100. The cavity 102 and the plug opening 152 are each adapted to receive the plug 180. The body member 110 and the cover member 150 are adapted to be joined together in a cooperative manner, as described in more detail below. The connector assembly 100 also includes electrical connection conductors 184 and, optionally, shorting bars 186.

Referring to the body member 110 in more detail, the body member 110 includes an upper peripheral edge 114 (FIGS. 4 and 6). The upper peripheral edge 114 includes a front edge portion 114A, a rear edge portion 114B, front sidewall edges 114C, and rear sidewall edges 114D. The upper peripheral edge 114 defines a top opening 116 of the body member 110.

Figure 5:
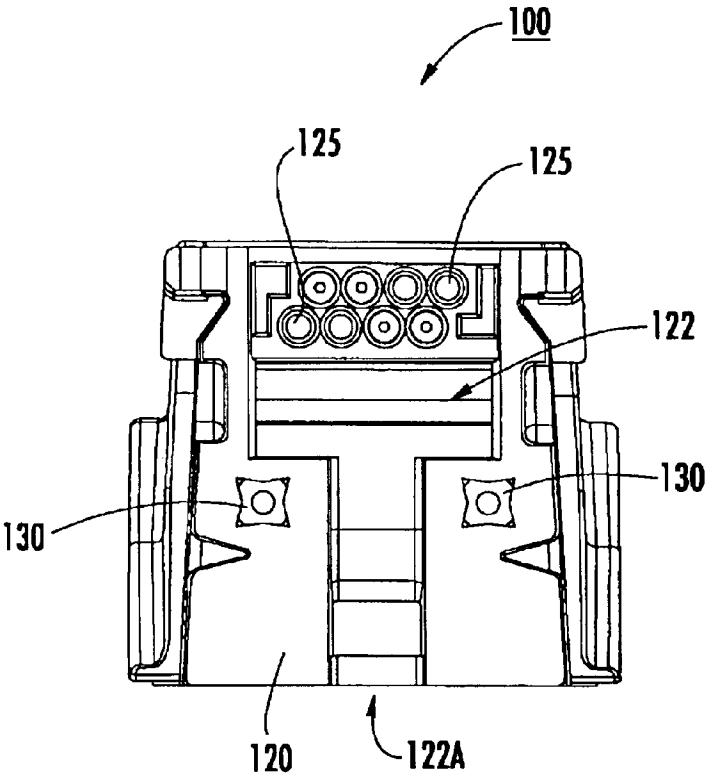
FIG. 5 is a bottom plan view of the connector assembly of FIG. 1.
Figure 11:
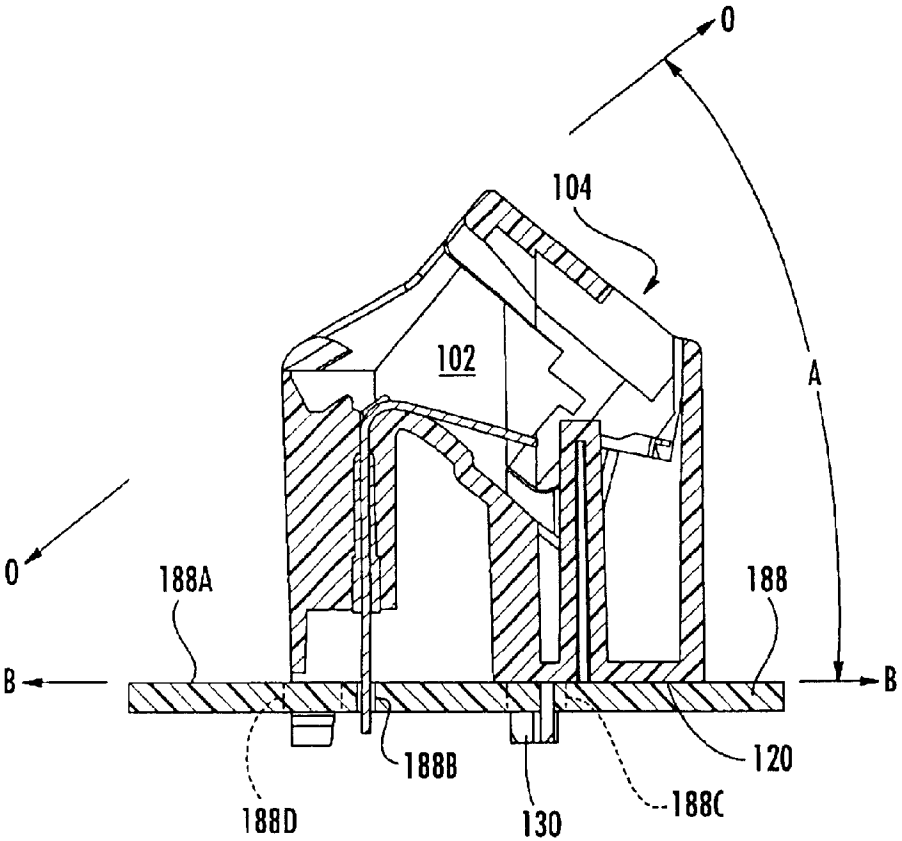
FIG. 11 is a cross-sectional view of the connector assembly of FIG. 1 mounted on a substrate.

As best seen in FIGS. 5 and 7, the body member 110 has a bottom wall 120 generally defining a base plane B-B (FIG. 11). A bottom cavity 122 is formed in the bottom wall 120 and has a side opening 122A. A plurality of conductor passages 124 fluidly connect the bottom cavity 122 and the body cavity 112. A plurality of recesses 125 open to the bottom of the body member 100 but do not communicate with the cavity 112. If additional conductors are desired, these recesses 125 may be opened (e.g., during molding or by drilling). In particular, the connector assembly 100 may be converted from an RJ-11 jack to an RJ-45 jack by opening the recesses 125 and inserting four additional conductors 184 through the passages so formed.

Figure 10:
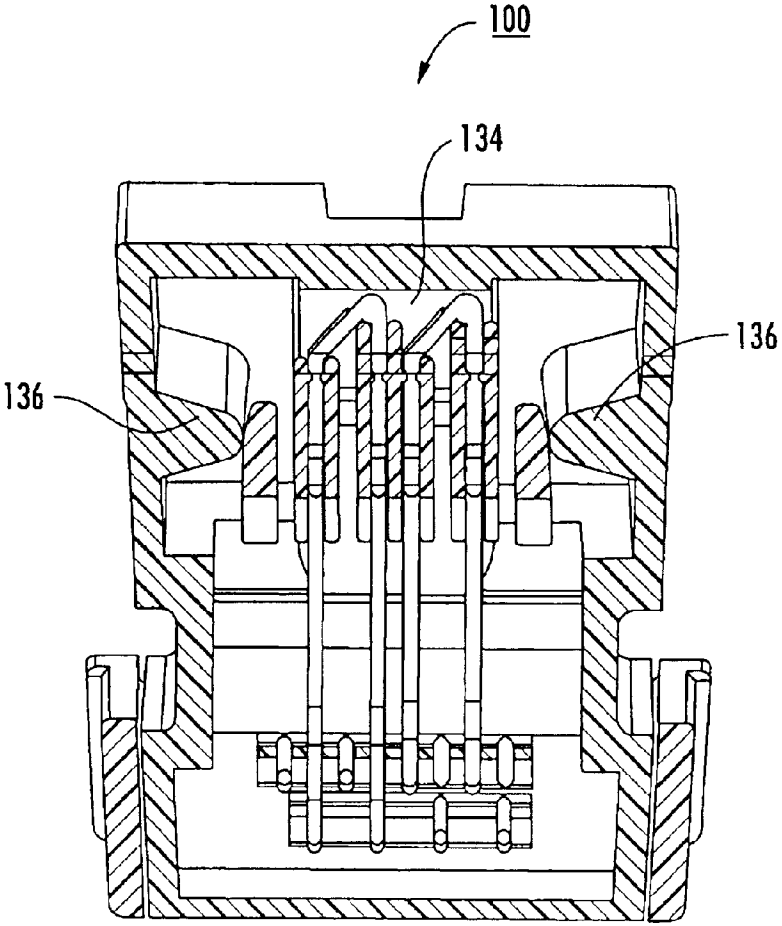
FIG. 10 is a cross-sectional view of the connector assembly of FIG. 1 taken along the line 10—10 of FIG. 7.

A pair of latch recesses 126 (FIGS. 3 and 4) are formed in the side walls of the body member 110. A pair of integral mounting structures 130 (FIGS. 2 and 5) extend downwardly from the bottom wall 120. Optionally, the mounting structures 130 may be provided with barbs. A pair of guide rails 132 (FIGS. 3 and 6) extend outwardly along the rear side wall edges 114D. A rear locating platform 134 and a pair of side locating platforms 136 are disposed in the cavity 112 (FIGS. 6 and 10).

The body member 110 is preferably unitarily formed. The body member 110 is formed such that, with the exception of the conductor passages 124, the cavity 112 is fully fluid sealed up to at least a minimum prescribed or desired sealant fill level.

A plurality of electrically conductive conductors 184 are mounted in the body member 110. The conductors 184 are preferably tines, for example, stamped tines or wire tines, with crimp barrels mounted thereon. However, other suitable conductors may be used.

With reference to FIG. 7, each conductor 184 includes a lead or pin 184A which is disposed in the bottom cavity 122 and extends downwardly below the body member 110. Each conductor 184 also includes a contact portion 184D which is disposed in the cavity 112. Preferably, and as illustrated, the contact portions 184D are tine-shaped contact wires that extends horizontally rearwardly. More preferably, the contact portions 184D are flexible and resilient so as perform as a cantilevered springs about the body member 110.

Each conductor 184 includes a sealing portion 184E disposed in a respective one of the passages 124. The crimp barrel of each conductor 184 has an upper sealing portion 184C and a lower sealing portion 184B (which is wider than the portion 184C) disposed in a respective one of the conductor passages 124. The passage 124 is sized and shaped to complement the sealing portions 184B, 184C, 184E and to form a fluid sealing, interference fit with the sealing portions 184B, 184C, 184E. In this manner, the conductor passages 124 are fluid sealed and the cavity 112 is thereby fluid sealed up to the desired sealant fill level. Preferably, when the portions 184B, 184C, 184E are fully mounted in the passages 124, the body member 110 is slightly deformed to elastically seal against the portions 184B, 184C, 184E.

Figure 3:
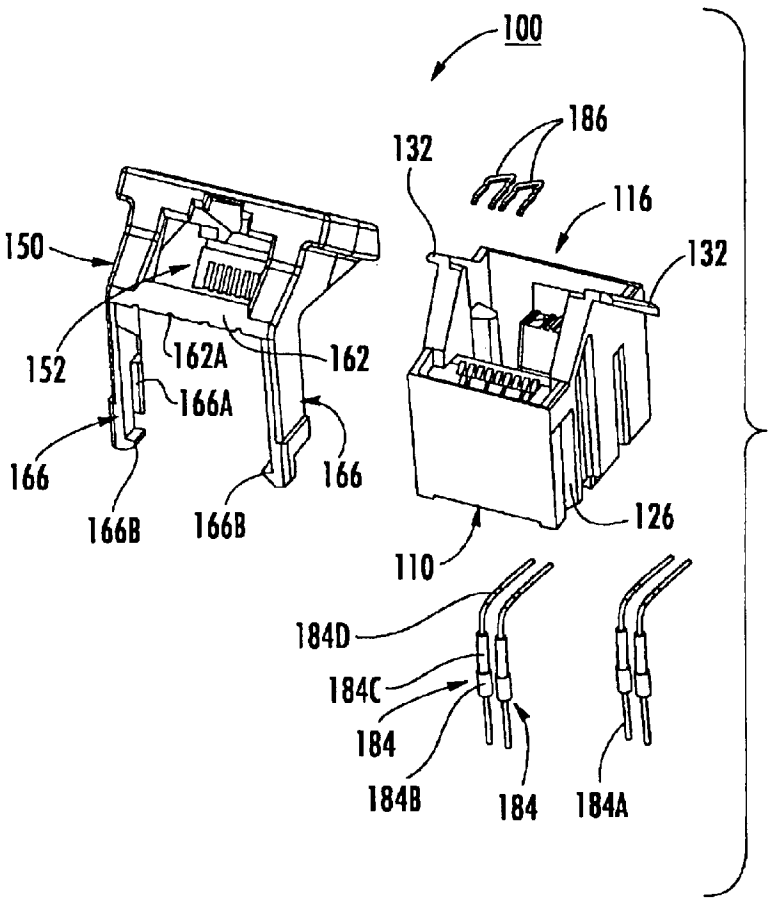
FIG. 3 is a front, exploded, perspective view of the connector assembly of FIG. 1.

Turning to the cover member 150 in more detail and with reference to FIG. 3, the cover member 150 has a rear wall 154, guide channels 156, a contact guide 160, a cross bar 162 and a pair of board mounting structures 166. The contact guide 160 defines slots 160A and has holding tabs 160B extending into the slots 160A (see FIG. 8). The cross bar 162 has air relief passages 162A along the bottom edge of the cross bar 162. The board mounting structures 166 are integral legs that can be elastically deflected outwardly about their intersections with the cover member 150. The board mounting structures 166 include latch projections 166A and barbs 166B. Slots 164A, 164B are formed in the rear wall 154.

Figure 13:
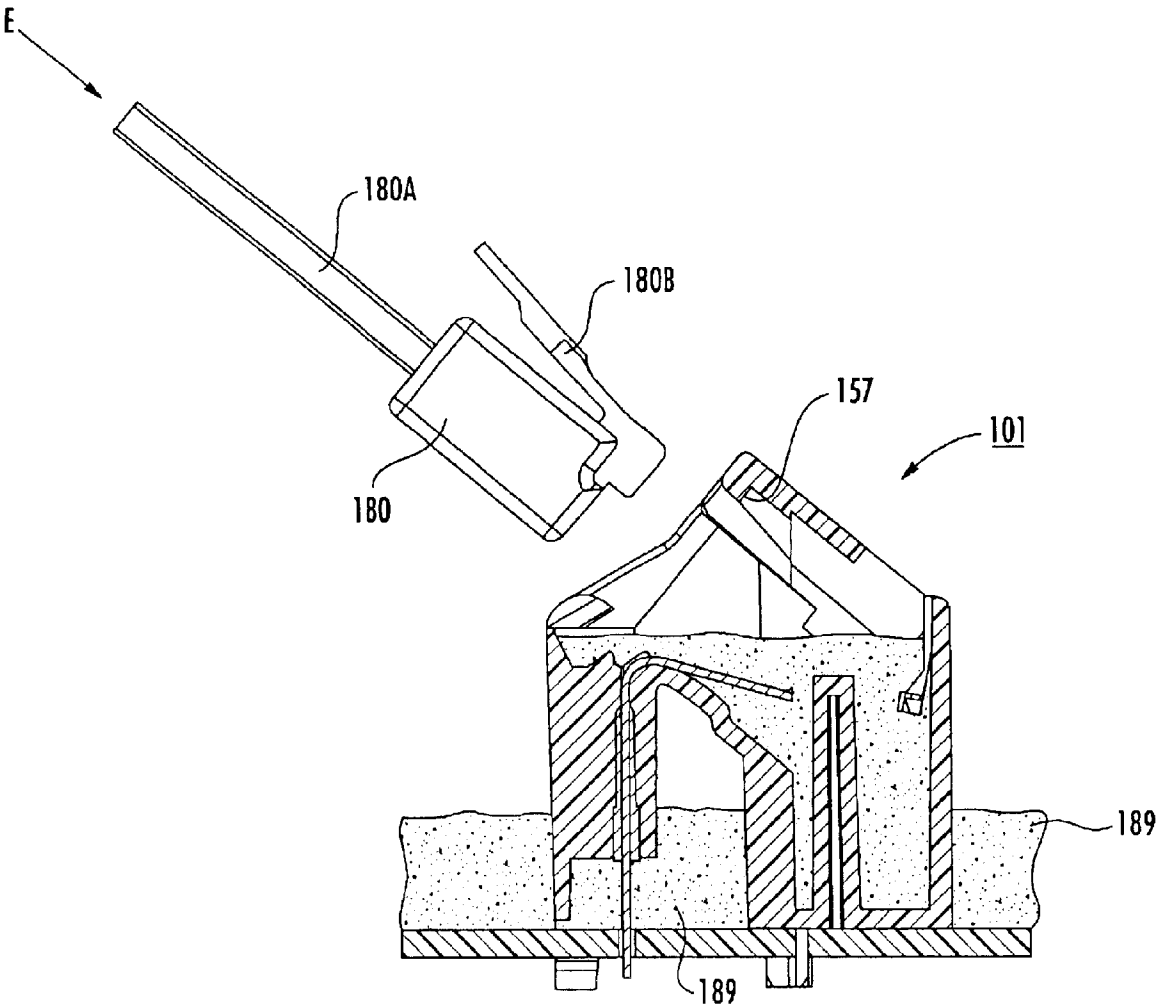
FIG. 13 is a cross-sectional view of the sealant-filled connector assembly of FIG. 12 mounted on the substrate along with a layer of potting material and a RJ-type connector plug.

The opening 152 defines generally an opening plane O-O (FIG. 11). The opening 152 is configured so as to complement the shape of the connector plug 180 and to guide the plug 180 into the cavity 102 at a prescribed angle. One or more latch recesses 157 (FIG. 13) are formed in the cover member 150 adjacent the opening 152 and facing the cavity 102. The latch recess(es) 157 are configured to interlock with a latch projection 180B of a plug 180, for example, in conventional manner.

Figure 8:
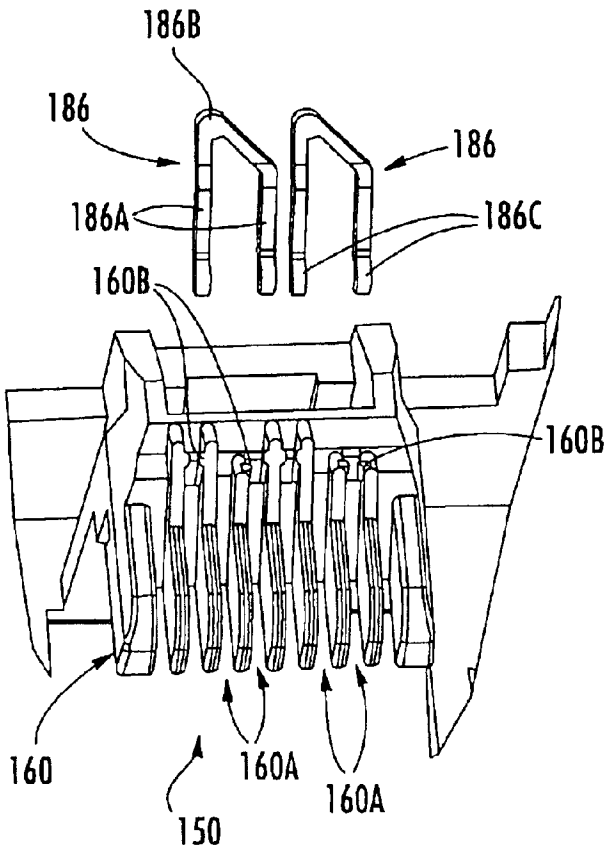
FIG. 8 is a fragmentary, exploded, enlarged, perspective view of a cover member and shorting bars forming a part of the connector assembly of FIG. 1.
Figure 9:
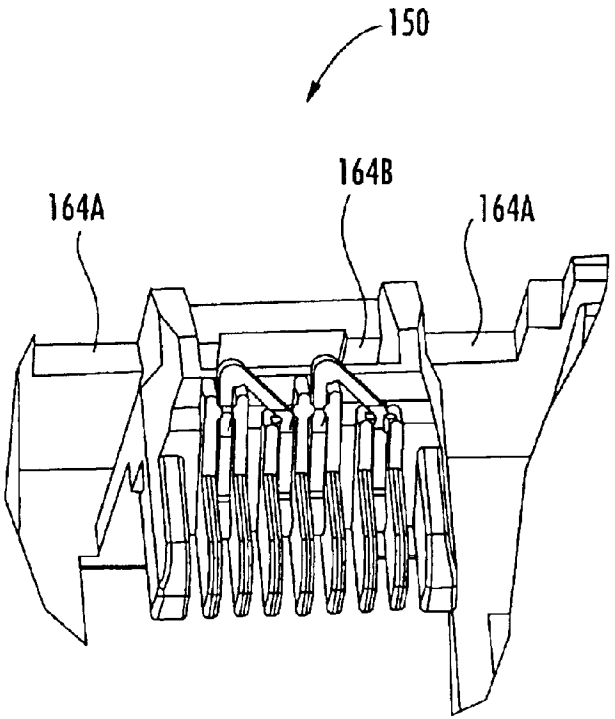
FIG. 9 is a fragmentary, enlarged, perspective view of the cover member and shorting bars of FIG. 8.

As best seen in FIGS. 8–10, the shorting bars 186 are mounted in the slots 160A. Each shorting bar includes a pair of legs 186A, a connecting portion 186B and downwardly projecting contact portions 186C. The shorting bars 186 are press fit into the slots 160A such that the legs 186A are captured by the holding tabs 160B. Preferably, the shorting bars are not molded into the cover member 150. In the assembled connector 100, the shorting bars 186 are locked in place by cooperation between the contact guide 160 and the platform 134.

At least the portions 186C of the shorting bars 186 contact respective ones of the contact portions 184D to electrically connect or short respective pairs of the contact portions 184D. The assembly 100 is configured such that, when the plug 180 is fully inserted, the plug 180 will displace the contact portions 184D away from and out of electrical contact with the shorting bars 186. Upon removal of the plug 180, the contact portions 184D will spring back into contact with at least the portions 186C.

The shorting bars 186 may be used to provide a test port or jack, for example, in a network interface device (NID). More particularly, such a test jack may be used to test a telephony circuit at the connection point between a telephone company's central office and a customer's wiring. According to other embodiments, no shorting bar is provided.

As discussed below, the cover member 150 is mounted on the body member 110 by sliding the guide channels 156 along the guide rails 132 until the latch projections 166A are received in the latch recesses 126. The cross bar 162 overlies the front edge 114A. The contact guide 160 is disposed in the cavity 112 such that the contact portions 184D are captured in the slots 160A. The plug opening 152 communicates with the cavity 112, and the cover member 150 and the cavity 112 together form the cavity 102. Also, the slots 164A and 164B in combination with the rear peripheral edge 114B form three sealant displacement openings 104.

Preferably and with reference to FIG. 11, the angle A defined between the plane O-O of the opening 152 and the plane B-B of the bottom wall 120 is between about 40 and 60 degrees. More preferably, the angle A is between about 45 and 55 degrees.

Figure 12:
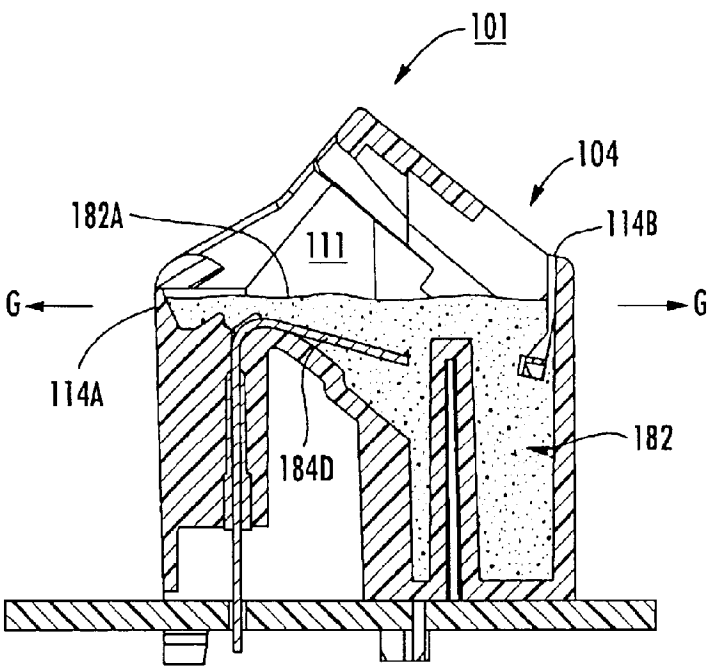
FIG. 12 is a cross-sectional view of the connector assembly of FIG. 1 mounted on the substrate of FIG. 11 and filled with a sealant material.

As discussed above, the connector assembly 100 may form a part of a sealant-filled connector assembly 101 according to embodiments of the present invention. As best seen in FIG. 12, the sealant 182 fills a substantial portion of the cavity 112 up to a sealant upper surface 182A at the desired sealant fill level. The sealant upper surface 182A is preferably below the front edge 114A and the rear edge 114B but above all of the contact portions 184D. Preferably, the sealant upper surface 182A is disposed a nominal distance of between about 0.030 and 0.130 inch above the uppermost contact portion 184D. In this manner, full coverage of the contact portions 184D with the sealant 182 may be ensured until the plug 180 is inserted. A void 111 is defined within the cavity 102 by the sealant upper surface 182A and the members 110, 150. The sealant upper surface 182A defines generally a plane G-G. Preferably, as described below, the plane G-G is approximately parallel to the plane B-B of the bottom wall 120.

Notably, the oblique orientation of the opening 152 relative to the sealant upper surface 182A may provide a preferred or ideal relationship between the configuration of the sealant material 182 and the angle and location of entry of the plug 180. That is, it is generally preferred that the sealant material upper surface 182A extend generally parallel to the contact portions 184D and that the sealant thickness increase as the sealant 182 extends further into the cavity 102. The configuration of the cavity 102 and the placement of the contact portions 184D inherently provide these characteristics when the connector assembly 100 is filled in a horizontal orientation as described below. The relative angle A of the opening 152 ensures that the plug 180 enters the connector housing 105 and engages the contact portions 184D at the preferred angle.

The body member 110 and the cover member 150 may be formed of any suitable material. Preferably, the members 110 and 150 are formed of a polymeric material. The body member 110 and the cover member 150 are preferably molded. More preferably, the members 110, 150 are injection molded.

Notably, the undercut latch recess 157 can be efficiently and effectively formed in the cover member 150 using conventional molding techniques such as injection molding. Therefore, the body member 110 can likewise be formed using a simple molding process as it is not necessary to form the latch recess 157 or other undercut structures in the body member 110, which might otherwise require a special molding technique because of the enclosed configuration of the body member 110.

The conductors 184 may be formed of any suitable material. Preferably, the conductors 184 are formed of a conventional electrically conductive material for this purpose, such as copper. The contact portions 184D and the pins 184A are preferably gold-plated.

The sealant material 182 is preferably a gel. The term "gel" has been used in this art to cover a vast array of materials from greases to thixotropic compositions to fluid-extended polymeric systems. As used herein, "gel" refers to the category of materials which are solids extended by a fluid extender. The gel may be a substantially dilute system that exhibits no steady state flow. As discussed in Ferry, "Viscoelastic Properties of Polymers," 3rd ed. p. 529 (J. Wiley & Sons, New York 1980), a polymer gel may be a cross-linked solution whether linked by chemical bonds or crystallites or some other kind of junction. The absence of the steady state flow may be considered to be the key definition of the solid-like properties while the substantial dilution may be necessary to give the relatively low modulus of gels. The solid nature may be achieved by a continuous network structure formed in the material generally through crosslinking the polymer chains through some kind of junction or the creation of domains of associated substituents of various branch chains of the polymer. The crosslinking can be either physical or chemical as long as the crosslink sites may be sustained at the use conditions of the gel.

Preferred gels for use in this invention are silicone (organopolysiloxane) gels, such as the fluid-extended systems taught in U.S. Pat. No. 4,634,207 to Debbaut (hereinafter "Debbaut '207"); U.S. Pat. No. 4,680,233 to Camin et al.; U.S. Pat. No. 4,777,063 to Dubrow et al.; and U.S. Pat No. 5,079,300 to Dubrow et al. (hereinafter "Dubrow '300"). These fluid-extended silicone gels may be created with nonreactive fluid extenders as in the previously recited patents or with an excess of a reactive liquid, e.g., a vinyl-rich silicone fluid, such that it acts like an extender, as exemplified by the Sylgard® 527 product commercially available from Dow-Coming of Midland, Michigan or as disclosed in U.S. Pat. No. 3,020,260 to Nelson. Because curing is involved in the preparation of these gels, they are sometimes referred to as thermosetting gels. An especially preferred gel is a silicone gel produced from a mixture of divinyl terminated polydimethylsiloxane, tetraks (dimethylsiloxy)silane, a platinum divinyltetramethyldisiloxane complex, commercially available from United Chemical Technologies, Inc. of Bristol, Pa., polydimethylsiloxane, and 1,3,5,7-tetravinyltetra methylcyclotetrasiloxane (reaction inhibitor for providing adequate pot life).

Other types of gels may be used, for example, polyurethane gels as taught in the aforementioned Debbaut '261 and U.S. Pat. No. 5,140,476 Debbaut (hereinafter "Debbaut '476") and gels based on styrene-ethylene butylenestyrene (SEBS) or styrene-ethylene propylene-styrene (SEPS) extended with an extender oil of naphthenic or nonaromatic or low aramatic content hydrocarbon oil, as described in U.S. Pat. No. 4,369,284 to Chen; U.S. Pat. No. 4,716,183 to Gamarra et al.; and U.S. Pat. No. 4,942,270 to Gamarra. The SEBS and SEPS gels comprise glassy styrenic microphases interconnected by a fluid-extended elastomeric phase. The microphase-separated styrenic domains serve as the junction points in the systems. The SEBS and SEPS gels are examples of thermoplastic systems.

Another class of gels which may be considered are EPDM rubber-based gels, as described in U.S. Pat. No. 5,177,143 to Chang et al.

Yet another class of gels which may be suitable are based on anhydride containing polymers, as disclosed in WO 96/23007. These gels reportedly have good thermal resistance.

The gel may include a variety of additives, including stabilizers and antioxidants such as hindered phenols (e.g., Irganox™ 1076, commercially available from Ciba-Geigy Corp. of Tarrytown, N.Y.), phosphites (e.g., Irgafos™ 168, commercially available from Ciba-Geigy Corp. of Tarrytown, N.Y.), metal deactivators (e.g., Irganox™ D1024 from Ciba-Geigy Corp. of Tarrytown, N.Y.), and sulfides (e.g., Cyanox LTDP, commercially available from American Cyanamid Co. of Wayne, N.J.), light stabilizers (i.e., Cyasorb UV-531, commercially available from American Cyanamid Co. of Wayne, N.J.), and flame retardants such as halogenated paraffins (e.g., Bromoklor 50, commercially available from Ferro Corp. of Hammond, Ind.) and/or phosphorous containing organic compounds (e.g., Fyrol PCF and Phosflex 390, both commercially available from Akzo Nobel Chemicals Inc. of Dobbs Ferry, N.Y.) and acid scavengers (e.g., DHT-4A, commercially available from Kyowa Chemical Industry Co. Ltd through Mitsui & Co. of Cleveland, Ohio, and hydrotalcite). Other suitable additives include colorants, biocides, tackfiers and the like described in "Additives for Plastics, Edition 1" published by D.A.T.A., Inc. and The International Plastics Selector, Inc., San Diego, Calif.

The hardness, stress relaxation, and tack may be measured using a Texture Technologies Texture Analyzer TA-XT2 commercially available from Texture Technologies Corp. of Scarsdale, N.Y., or like machines, having a five kilogram load cell to measure force, a 5 gram trigger, and ¼ inch (6.35 mm) stainless steel ball probe as described in Dubrow '300, the disclosure of which is incorporated herein by reference in its entirety. For example, for measuring the hardness of a gel, a 60 mL glass vial with about 20 grams of gel, or alternately a stack of nine 2 inch×2 inch×⅛" thick slabs of gel, is placed in the Texture Technologies Texture Analyzer and the probe is forced into the gel at the speed of 0.2 mm/sec to a penetration distance of 4.0 mm. The hardness of the gel is the force in grams, as recorded by a computer, required to force the probe at that speed to penetrate or deform the surface of the gel specified for 4.0 mm. Higher numbers signify harder gels. The data from the Texture Analyzer TA-XT2 may be analyzed on an IBM PC or like computer, running Microsystems Ltd, XT.RA Dimension Version 2.3 software.

The tack and stress relaxation are read from the stress curve generated when the software automatically traces the force versus time curve experienced by the load cell when the penetration speed is 2.0 mm/second and the probe is forced into the gel a penetration distance of about 4.0 mm. The probe is held at 4.0 mm penetration for 1 minute and withdrawn at a speed of 2.00 mm/second. The stress relaxation is the ratio of the initial force ($F_i$) resisting the probe at the pre-set penetration depth minus the force resisting the probe ($F_f$) after 1 min divided by the initial force $F_i$, expressed as a percentage. That is, percent stress relaxation is equal to $$\frac{(F_i - F_f)}{F_i} \times 100\%$$

where $F_i$ and $F_f$ are in grams. In other words, the stress relaxation is the ratio of the initial force minus the force after 1 minute over the initial force. It may be considered to be a measure of the ability of the gel to relax any induced compression placed on the gel. The tack may be considered to be the amount of force in grams resistance on the probe as it is pulled out of the gel when the probe is withdrawn at a speed of 2.0 mm/second from the preset penetration depth.

An alternative way to characterize the gels is by cone penetration parameters according to ASTM D-217 as proposed in Debbaut '261; Debbaut '207; Debbaut '746; and U.S. Pat. No. 5,357,057 to Debbaut et al., each of which is incorporated herein by reference in its entirety. Cone penetration ("CP") values may range from about 70 ($10^{-1}$ mm) to about 400 ($10^{-1}$ mm). Harder gels may generally have CP values from about 70 ($10^{-1}$ mm) to about 120 ($10^{-1}$ mm). Softer gels may generally have CP values from about 200 ($10^{-1}$ mm) to about 400 ($10^{-1}$ mm), with particularly preferred range of from about 250 ($10^{-1}$ mm) to about 375 ($10^{-1}$ mm). For a particular materials system, a relationship between CP and Voland gram hardness can be developed as proposed in U.S. Pat. No. 4,852,646 to Dittmer et al.

Preferably, the sealant 182 is a gel having a Voland hardness, as measured by a texture analyzer, of between about 5 and 100 grams force, more preferably of between about 5 and 30 grams force, and, most preferably, of between about 10 and 20 grams force. Preferably, the gel has an elongation, as measured by ASTM D-638, of at least 55%, more preferably of at least 100%, and most preferably of at least 1,000%. Preferably, the gel has a stress relaxation of less than 80%, more preferably of less than 50%, and most preferably of less than 35%. The gel has a tack preferably greater than about 1 gram, more preferably greater than about 6 grams, and most preferably between about 10 and 50 grams. Suitable gel materials include POWERGEL sealant gel available from Tyco Electronics Energy Division of Fuqua-Varina, NC under the RAYCHEM brand.

The connector 100 and the sealant-filled connector assembly 101 may be formed using a method according to preferred method embodiments of the present invention as follows. The conductors 184 are inserted up through the respective conductor passages 124 such that the portions 184B, 184C form a sealing interference fit as described above. The width reductions in the passages 124 may serve as stops to positively locate the conductors 184. The respective contact portions 184D are bent over rearwardly.

The shorting bars 186 are press fit into the slots 160A. The widths of the slots 160A and the holding tabs 160B ensure that the shorting bars 186 are retained in the slots 160A.

The cover member 150 is mounted on the body member 110 by sliding the guide channels 156 over the guide rails 132 as discussed above to form the connector housing 105. The contact guide 160 is positively positioned relative to the body member 110 by the side platforms 136. The shorting bars 186 are positively positioned and locked in place by the rear wall of the body member 110 and the platform 134. At least the portions 186C of the shorting bars 186 contact the contact portions 184D.

The connector housing 105 is then mounted on the substrate 188 such that the bottom wall 120 mates with an upper surface 188A of the substrate 188. The board mounting structures 130 are received in holes 188C in the substrate 188. The barbs 166B of the board mounting structures 166 are received in holes 188D of the substrate 188 to thereby lock the cover member 150 as well as the body member 110 to the substrate 188. The pins 184A are received in respective holes 188B of the substrate 188. Typically, the holes 188B are contacts or lead to contacts so that the pins 184A are thereby electrically connected to a desired electrical circuit. In particular, the desired electrical circuit may be printed or otherwise mounted on the substrate 188 (i.e., a printed circuit board (PCB)) so that the circuit and the connector 100 are mounted on a common board and the connector 100 is directly connected to the electrical circuit by the pins 184A.

If a sealant-filled connector assembly is desired, a liquid, uncured sealant material corresponding to the sealant 182 is then poured, injected or otherwise inserted into the cavity 102 through the opening 152. During and following the insertion of the uncured sealant material, the substrate surface 188A is mounted in a substantially fully horizontal orientation so that the upper surface of the liquid, uncured sealant material is substantially parallel to the base plane B-B. Notably, the opening plane O-O of the opening 152 is disposed at the desired angle A with respect to the upper surface 188A of the substrate, allowing for convenient and effective insertion of the liquid sealant material. The body member cavity 112 is filled with the liquid until the desired level of liquid, uncured sealant material is achieved. The air relief passages 162A help to ensure that no air bubbles are captured in the liquid sealant material.

Because the cavity 112 of the unitary body member 100 is fully fluidly sealed by the sealing portions 184B, 184C, 184E and up to at least the desired sealant fill level, it is not necessary to tape or otherwise prepare the connector assembly 100 to hold the liquid, uncured sealant material.

Thereafter, the liquid, uncured sealant material is cured in the cavity 112 to form the sealant material 182. Depending on the chosen sealant material, the liquid, uncured sealant material may be air cured or may be cured by other or additional means. For example, the liquid sealant material may be cured by exposing to heat or infrared radiation in situ.

Notably, the connector assembly 100 may be provided with the shorting bars 186 without requiring one or more holes to be formed in the body member 110. Rather, the cover member 150 holding the shorting bars 186 is installed on the unitary body member 110 within which the contact portions 184D are preinstalled.

Before or after installing the sealant 182, the sealant material 189 may be applied. The sealant material 189 is preferably applied such that it covers the substrate 188 in conventional manner, and also enters the bottom cavity 122 through the opening 122A (see FIG. 13). Preferably, at least the opening 122A of the bottom cavity 122 is substantially completely filled with the sealant material 189. The sealant material 189 in the bottom cavity 122 seals the pins 184A from the surrounding environment.

The sealant material 189 may be any suitable hard or soft environmental sealant material. Preferably, the sealant material 189 is a potting material, a mastic, an adhesive or a gel. However, other suitable sealants may be used.

In use, the plug 180 is inserted through the plug opening 152 into the connector assembly cavity 102 as shown in FIG. 14 such that the electrical contacts of the plug 180 engage the contact portions 184D for electrical connection in conventional manner. The opening 152 guides the plug 180 such that it enters the cavity 102 along an entry direction E (FIG. 13) that is obliquely oriented relative to the substrate 188. As the plug 180 is inserted, the portions 182B of the sealant material 182 are displaced through the openings 104 to the environment. The plug 180 is retained in the connector assembly 100 by an interlock between the latch projection 180B and the latch recess 157. Upon removal of the plug 180 from the cavity 102, the portions 182B of the sealant 182 return to the cavity 102 through the openings 104.

Figure 15:
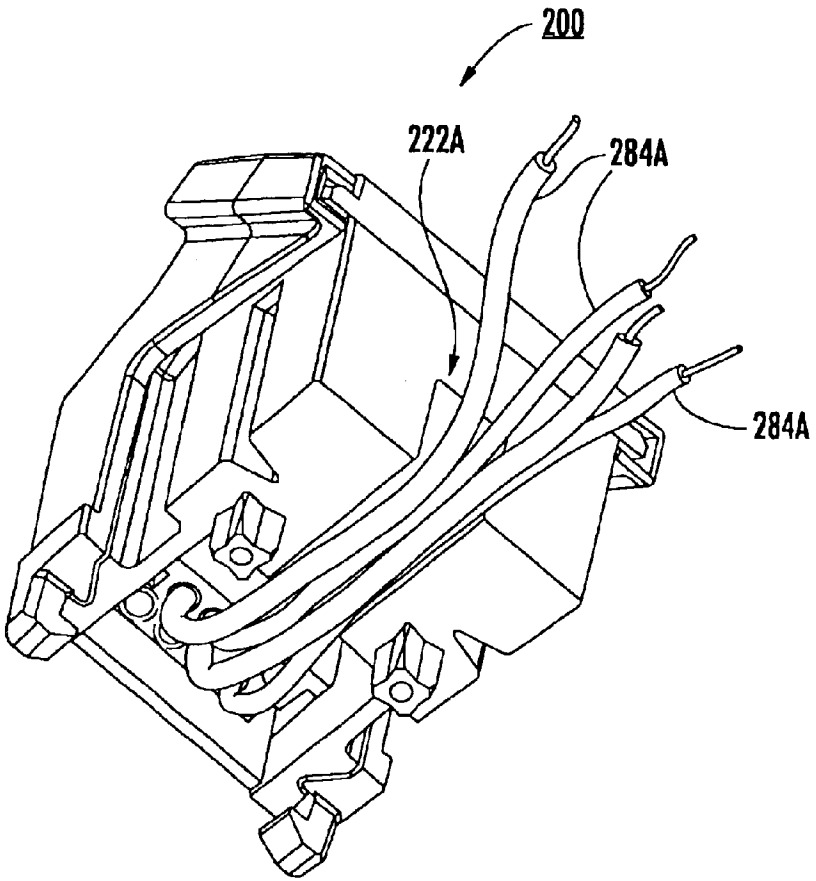
FIG. 15 is a bottom, perspective view of a connector assembly according to further embodiments of the present invention.

With reference to FIG. 15, a connector assembly 200 according to further embodiments of the present invention is shown therein. The connector assembly 200 corresponds to the connector assembly 100 except as follows. In the connector assembly 200, insulated, electrically conductive wires 284A are provided in place of the pins 184A. The wires 284A can be routed through the cavity 222A if the assembly 200 is mounted on a circuit board or other substrate. The assembly 200 may also be sealant filled, as discussed with regard to the sealant-filled connector assembly 101. The crimp barrels may be mounted on the conductors such that the upper sealing portion surrounds and holds the conductor of the wire and the lower sealing portion surrounds and holds the insulation of the wire.

Figure 16:
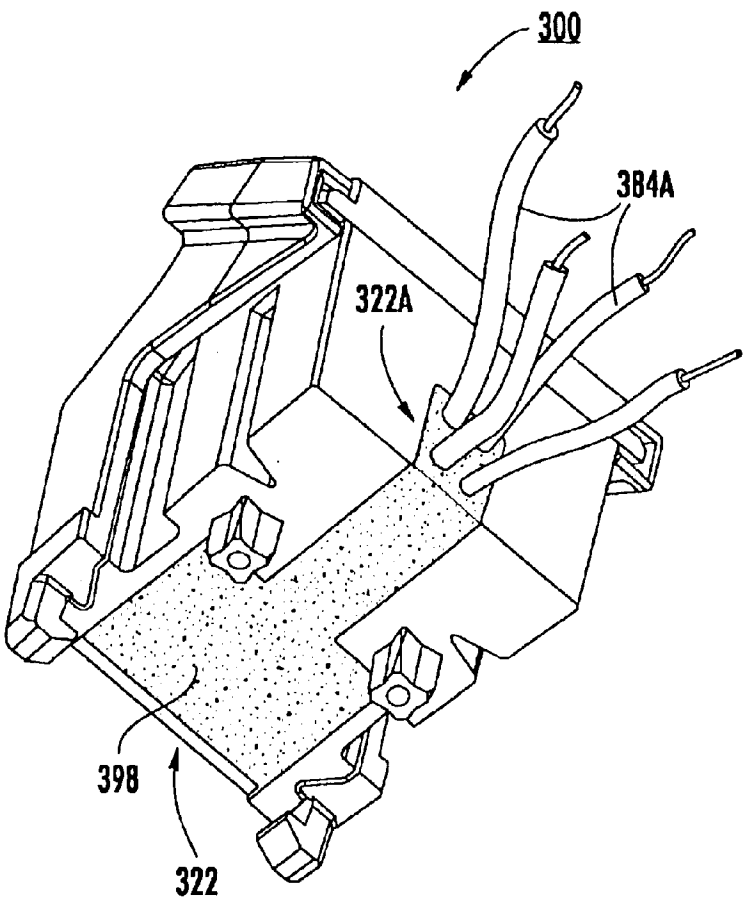
FIG. 16 is a bottom, perspective view of a connector assembly according to further embodiments of the present invention.

With reference to FIG. 16, a connector assembly 300 according to further embodiments of the present invention is shown therein. The connector assembly 300 corresponds to the connector assembly 100 except as follows. Instead of introducing potting material into the bottom cavity when the connector assembly is on a circuit board or other substrate, a sealant material 389 corresponding to the sealant material 189 is pre-introduced in the bottom cavity 322. The wires 384A are encased in the potting material 389 and are routed through the opening 322A. The connector assembly 300 may also be sealant filled as described above with regard to the sealant-filled connector assembly 101.

Connector assemblies according to the present invention may provide a number of advantages and benefits such as improved modularity and versatility. The base member 110 and the cover member 150, for example, may be used to form either pin or wire connection assemblies. The members 110, 150 may be used for board mount applications or for other types of applications. More or fewer conductors (e.g., the conductors 184) may be provided.

The orientation of the plug opening 152 allows the sealant material to be installed with the connector assembly 100 in its operational orientation. The sealant material may be installed by the connector manufacturer and provided to a downstream manufacturer/assembler as a sealant-filled connector. The connector assembly may be conveniently and cost-effectively manufactured by mounting the body member 110 and the cover member 150 temporarily on substrates for filling the sealant material. Alternatively, the downstream manufacturer, for example, a circuit board manufacturer, may assemble the connector assembly 100 on a board and install the sealant material while the connector assembly 100 is on the circuit board. The configuration of the connector assembly and the orientation of the opening 152 may ensure that the sealant material is provided in the proper amount and configuration relative to the contact portions 184D, and the insertion angle of the associated plug.

While the connectors have been described and illustrated having tine-shaped contact portions (e.g., the contact portions 184D), other types and configurations of conductors may be used.

While connector housings (e.g., the connector housing 105) according to preferred embodiments having two body pieces (e.g., a body member 110 and a cover member 150) have been described herein, certain aspects and features of the present invention may be employed in connector assemblies having connector housings including more or fewer body pieces. For example, a connector assembly according to embodiments of the present invention may include a unitary connector housing having both a cavity for receiving a connector plug and an opening that is obliquely oriented relative to a bottom wall of the connector body and adapted to receive a connector plug.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A sealant-filled connector assembly for use with a connector plug, the assembly comprising:

a) a connector housing including a unitary body portion defining a body cavity and at least one conductor passage extending through the unitary body portion and communicating with the body cavity, the connector housing defining a connector opening communicating with the body cavity, the connector opening being adapted to receive the connector plug;

b) at least one electrical conductor extending through each conductor passage and having a contact portion disposed in the body cavity; and c) an environmental sealant disposed in the body cavity up to a sealant fill level and at least partially covering each said contact portion;

d) wherein the unitary body portion is devoid of openings other than the at least one conductor passage up to at least the sealant fill level and each conductor passage is sealed by a respective conductor so as to prevent escape of said sealant from the unitary body portion therethrough.

2. The connector assembly of claim 1 wherein:

the at least one conductor passage includes a plurality of conductor passages extending through the unitary body portion; and a respective electrical conductor extends through each of the plurality of conductor passages.

3. The connector assembly of claim 2 wherein the plurality of conductor passages includes at least four conductor passages each having a respective electrical conductor extending therethrough.

4. The connector assembly of claim 2 wherein each of the conductor passages communicates with the body cavity below the sealant fill level and forms a fluid sealing, interference fit with the conductor extending through the conductor passage.

5. The connector assembly of claim 1 wherein the connector plug is an RJ-type connector plug.

6. The connector assembly of claim 5 wherein the connector plug is an RJ-45 connector plug.

7. The connector assembly of claim 1 wherein the sealant comprises a gel.

8. The connector assembly of claim 1 wherein the at least one conductor includes an outer portion extending from the unitary body portion.

9. The connector assembly of claim 8 wherein the connector housing defines an external cavity opposite the body cavity, and the outer portion of the at least one conductor extends through the external cavity.

10. The connector assembly of claim 9 including a second sealant disposed in the external cavity and at least partially surrounding the outer portion.

11. The connector assembly of claim 1 wherein the at least one contact portion is substantially fully covered by the environmental sealant.

12. A sealant-filled connector assembly for use with a connector plug, the assembly comprising:

a) a connector housing including a unitary body portion defining a body cavity and at least one conductor passage extending through the unitary body portion and communicating with the body cavity, the connector housing defining a connector opening communicating with the body cavity, the connector opening being adapted to receive the connector plug;

b) an electrical conductor extending through said at least one conductor passage and having a contact portion disposed in the body cavity; and c) an environmental sealant disposed in the body cavity up to a sealant fill level and at least partially covering each said contact portion;

d) wherein the unitary body portion is devoid of openings other than the at least one conductor passage up to at least the sealant fill level;

e) wherein the at least one conductor passage includes a plurality of conductor passages extending through the unitary body portion; and f) wherein a respective electrical conductor extends through each of the plurality of conductor passages; and g) wherein:

the unitary body portion is adapted to be mounted on a horizontal surface; and when the connector housing is mounted on the horizontal surface, the environmental sealant has an upper surface disposed substantially parallel to the horizontal surface and the contact portions extend substantially parallel to the horizontal surface.

13. A sealant-filled connector assembly for use with a connector plug, the assembly comprising:

a) a connector housing including a unitary body portion defining a body cavity and at least one conductor passage extending through the unitary body portion and communicating with the bode cavity, the connector housing defining a connector opening communicating with the body cavity, the connector opening being adapted to receive the connector plug;

b) an electrical conductor extending through said at least one conductor passage and having a contact portion disposed in the body cavity; and c) an environmental sealant disposed in the body cavity up to a sealant fill level and at least partially covering each said contact portion;

d) wherein the unitary body portion is devoid of openings other than the at least one conductor passage up to at least the sealant fill level; and e) wherein the connector housing comprises a body member and a cover member mounted on the body member, wherein the body member includes the unitary body portion and the cover member defines the connector opening.

14. The connector assembly of claim 13 wherein the cover member further defines at least one recess therein, and further including an electrically conductive shorting bar secured in the recess such that the shorting bar is retained in the cover member and engages each of a pair of the contact portions to electrically short circuit the engaged contact portions.

15. The connector assembly of claim 14 wherein the shorting bar is press-fit into the recess.

16. The connector assembly of claim 14 including locating means to positively position the shorting bar relative the body member.

17. The connector assembly of claim 14 including guide means to positively position the cover member relative the body member.

18. The connector assembly of claim 14 adapted such that, when the connector plug is inserted into the body cavity, the contact portions are thereby displaced out of contact with the shorting bar.

19. The connector assembly of claim 13 wherein the cover member includes at least one deflectable leg adapted to releasably secure the cover member to the body member.

20. The connector assembly of claim 13 being adapted for mounting on a substrate and further including a first mounting structure integral with the body member and configured to engage a first mounting hole of the substrate and a second mounting structure integral with the cover member and configured to engage a second mounting hole of the substrate such that the cover member is thereby secured to the substrate.

21. The connector assembly of claim 20 wherein the first mounting structure is integrally molded with the body member and the second mounting structure is integrally molded with the cover member.

22. The connector assembly of claim 20 wherein the second mounting structure includes at least one barb.

23. The connector assembly, of claim 11 wherein the cover member includes a latch recess adapted to interlock with the connector plug.

24. The connector assembly of claim 13 wherein the cover member is removably mounted on the body member.

25. A sealant-filled connector assembly for use with a connector plug, the assembly comprising:

a) a connector housing including a unitary body portion defining a body cavity and at least one conductor passage extending through the unitary body portion and communicating with the body cavity, the connector housing defining a connector opening communicating with the body cavity, the connector opening being adapted to receive the connector plug;

b) an electrical conductor extending through said at least one conductor passage and having a contact portion disposed in the body cavity; and c) an environmental sealant disposed in the body cavity up to a sealant fill level and at least partially covering each said contact portion;

d) wherein the unitary body portion is devoid of openings other than the at least one conductor passage up to at least the sealant fill level; and e) wherein:

the connector housing is adapted to be mounted on a horizontal surface; and the connector opening is disposed at an oblique angle relative to the horizontal surface when the connector housing is mounted on the horizontal surface.

26. The connector assembly of claim 25 wherein the connector opening is disposed at an angle of between about 40 and 60 degrees relative to the horizontal surface when the connector housing is mounted on the horizontal surface.

27. A sealant-filled connector assembly for use with a connector plug, the assembly comprising:

a) a connector housing including a unitary body portion defining a body cavity and at least one conductor passage extending through the unitary body portion and communicating with the body cavity, the connector housing defining a connector opening communicating with the body cavity, the connector opening being adapted to receive the connector plug;

b) an electrical conductor extending through said at least one conductor passage and having a contact portion disposed in the body cavity; and c) an environmental sealant disposed in the body cavity up to a sealant fill level and at least partially covering each said contact portion;

d) wherein the unitary body portion is devoid of openings other than the at least one conductor passage up to at least the sealant fill level; and e) wherein the sealant comprises a gel; and f) wherein the gel is a silicone gel and has at least one of a Voland hardness of between about 5 and 30 grams force, an elongation of at least 100%, a stress relaxation of no more than 50%, and a tack of greater than about 6 grams.

28. A sealant-filled connector assembly for use with a connector plug, the assembly comprising:

a) a connector housing including a unitary body portion defining a body cavity and at least one conductor passage extending through the unitary body portion and communicating with the body cavity, the connector housing defining a connector opening communicating with the body cavity, the connector opening being adapted to receive the connector plug;

b) an electrical conductor extending through said at least one conductor passage and having a contact portion disposed in the body cavity; and c) an environmental sealant disposed in the body cavity up to a sealant fill level and at least partially covering each said contact portion;

d) wherein the unitary body portion is devoid of openings other than the at least one conductor passage up to at least the sealant fill level;

e) wherein the at least one conductor includes an outer portion extending from the unitary body portion; and f) wherein the outer portion includes an electrically conductive pin adapted to engage a circuit board.

29. A sealant-filled connector assembly for use with a connector plug, the assembly comprising:

a) a connector housing including a unitary body portion defining a body cavity and at least one conductor passage extending through the unitary body portion and communicating with the body cavity, the connector housing definingz a connector opening communicating with the body cavity, the connector opening being adapted to receive the connector plug;

b) an electrical conductor extending through said at least one conductor passage and having a contact portion disposed in the body cavity; and c) an environmental sealant disposed in the body cavity up to a sealant fill level and at least partially covering each said contact portion;

d) wherein the unitary body portion is devoid of openings other than the at least one conductor passage up to at least the sealant fill level;

e) wherein the at least one conductor includes an outer portion extending from the unitary body portion; and f) wherein the outer portion includes an electrically conductive, insulated wire.

30. A sealant-filled connector assembly for use with a connector plug, the assembly comprising:

a) a connector housing including a unitary body portion defining a body cavity and at least one conductor passage extending through the unitary body portion and communicating with the body cavity, the connector housing defining a connector opening communicating with the body cavity, the connector opening being adapted to receive the connector plug;

b) an electrical conductor extending through said at least one conductor passage and having a contact portion disposed in the body cavity; and c) an environmental sealant disposed in the body cavity up to a sealant fill level and at least partially covering each said contact portion;

d) wherein the unitary body portion is devoid of openings other than the at least one conductor passage up to at least the sealant fill level; and e) wherein:

the connector housing further defines an overflow opening in fluid communication with each of the body cavity and the surrounding environment; and the connector housing is configured such that, when the connector plug is inserted into the body cavity through the connector opening, at least a portion of the sealant is thereby displaced from the body cavity, through the overflow opening and into the surrounding environment.

31. A method for forming a sealant-filled connector assembly for use with a connector plug, the method comprising:

a) providing a connector housing including a unitary body portion defining a body cavity and at least one conductor passage extending through the unitary body portion and communicating with the body cavity, the connector housing defining a connector opening communicating with the body cavity, the connector opening being adapted to receive the connector plug;

b) mounting a respective electrically conductive conductor in the at least one conductor passage such that the conductor has a contact portion disposed in the body cavity; and c) introducing an uncured sealant material into the body cavity up to a sealant fill level such that each contact portion is at least partially covered by the uncured sealant material; and d) curing the sealant material in the body cavity to form an environmental sealant in the body cavity;

e) wherein the unitary body portion is devoid of openings other than the at least one conductor passage up to at least the sealant fill level.

32. The method of claim 31 wherein the step of introducing the uncured sealant material includes introducing a liquid, uncured sealant material.

33. The method of claim 31 wherein the step of mounting the conductor(s) includes fluidly sealing the at least one conductor passage with the conductor(s).

34. The method of claim 31 including mounting the unitary body portion on a substrate prior to the steps of introducing the uncured sealant material and curing the sealant material.

35. The method of claim 31 wherein the connector plug is an RJ-type connector plug.

36. The method of claim 31 wherein the environmental sealant comprises a gel.

37. The method of claim 31 wherein the step of introducing the uncured sealant includes substantially fully covering the contact portion(s) with the uncured sealant.

38. The method of claim 31 wherein each conductor passage is sealed by a respective conductor so as to prevent escape of the sealant from the unitary body portion therethrough.

39. The method of claim 38 wherein the step of mounting the conductor(s) includes forming a fluidly sealing, interference fit between the at least one conductor passage and the conductor(s).

40. A method for forming a sealant-filled connector assembly for use with a connector plug, the method comprising:

a) providing a connector housing including a unitary body portion defining a body cavity and at least one conductor passage extending through the unitary body portion and communicating with the body cavity, the connector housing defining a connector opening communicating with the body cavity, the connector opening being adapted to receive the connector plug;

b) mounting a respective electrically conductive conductor in the at least one conductor passage such that the conductor has a contact portion disposed in the body cavity; and c) introducing an uncured sealant material into the body cavity up to a sealant fill level such that each contact portion is at least partially covered by the uncured sealant material; and d) curing the sealant material to form an environmental sealant in the body cavity;

e) wherein the unitary body portion is devoid of openings other than the at least one conductor passage up to at least the sealant fill level; and f) wherein the step of providing a connector housing includes:

providing a body member and a cover member, the body member including the unitary body portion and the cover member defining the connector opening; and mounting the cover member on the body member.

41. The method of claim 40 including mounting the connector housing on a substrate such that a first mounting structure integral with the body member engages a first mounting hole in the substrate and a second mounting structure integral with the cover member interlocks with a second mounting hole in the substrate.

42. A method for forming a sealant-filled connector assembly for use with a connector plug, the method comprising:

a) providing a connector housing including a unitary body portion defining a body cavity and at least one conductor passage extending through the unitary body portion and communicating with the body cavity, the connector housing defining a connector opening communicating with the body cavity, the connector opening being adapted to receive the connector plug;

b) mounting a respective electrically conductive conductor in the at least one conductor passage such that the conductor has a contact portion disposed in the body cavity; and c) introducing an uncured sealant material into the body cavity up to a sealant fill level such that each contact portion is at least partially covered by the uncured sealant material; and d) curing the sealant material to form an environmental sealant in the body cavity;

e) wherein the unitary body portion is devoid of openings other than the at least one conductor passage up to at least the sealant fill level; and f) wherein the connector opening is disposed at an oblique angle relative to horizontal during the steps of introducing the uncured sealant material and curing the sealant material.

43. A method for forming a sealant-filled connector assembly for use with a connector plug, the method comprising:

a) providing a connector housing including a unitary body portion defining a body cavity and at least one conductor passage extending through the unitary body portion and communicating with the body cavity, the connector housing defining a connector opening communicating with the body cavity, the connector opening being adapted to receive the connector plug;

b) mounting a respective electrically conductive conductor in the at least one conductor passage such that the conductor has a contact portion disposed in the body cavity; and c) introducing an uncured sealant material into the body cavity up to a sealant fill level such that each contact portion is at least partially covered by the uncured sealant material; and d) curing the sealant material to form an environmental sealant in the body cavity;

e) mounting the unitary body portion on a substrate prior to the steps of introducing the uncured sealant material and curing the sealant material;

f) wherein the unitary body portion is devoid of openings other than the at least one conductor passage up to at least the sealant fill level; and g) wherein the step of mounting the unitary body on the substrate includes electrically engaging an outer portion of the at least one conductor with an electrical circuit printed on the substrate.

44. A method for forming a sealant-filled connector assembly for use with a connector plug, the method comprising:

a) providing a connector housing including a unitary body portion defining a body cavity and at least one conductor passage extending through the unitary body portion and communicating with the body cavity, the connector housing defining a connector opening communicating with the body cavity, the connector opening being adapted to receive the connector plug;

b) mounting a respective electrically conductive conductor in the at least one conductor passage such that the conductor has a contact portion disposed in the body cavity; and c) introducing an uncured sealant material into the body cavity up to a sealant fill level such that each contact portion is at least partially covered by the uncured sealant material; and d) curing the sealant material to form an environmental sealant in the body cavity;

e) mounting the unitary body portion on a substrate prior to the steps of introducing the uncured sealant material and curing the sealant material; and f) applying a second sealant material to the substrate and the unitary body portion on the substrate to environmentally seal the connector assembly;

g) wherein the unitary body portion is devoid of openings other than the at least one conductor passage up to at least the sealant fill level.

45. A method for forming a sealant-filled connector assembly for use with a connector plug, the method comprising:

a) providing a connector housing including a unitary body portion defining a body cavity and at least one conductor passage extending through the unitary body portion and communicating with the body cavity, the connector housing defining a connector opening communicating with the body cavity, the connector opening being adapted to receive the connector plug;

b) mounting a respective electrically conductive conductor in the at least one conductor passage such that the conductor has a contact portion disposed in the body cavity; and c) introducing an uncured sealant material into the body cavity up to a sealant fill level such that each contact portion is at least partially covered by the uncured sealant material;

d) curing the sealant material to form an environmental sealant in the body cavity; and e) introducing a second sealant material into an external cavity defined in the connector housing opposite the body cavity such that the second sealant material forms a seal between the connector housing and the at least one conductor;

e) wherein the unitary body portion is devoid of openings other than the at least one conductor passage up to at least the sealant fill level.

46. The method of claim 45 including mounting the connector housing onto a substrate and wherein the step of placing the second sealant material includes forming a seal with the second sealant material between the connector housing and the substrate.

47. A method for forming a sealant-filled connector assembly for use with a connector plug, the method comprising:

a) providing a connector housing including a unitary body portion defining a body cavity and at least one conductor passage extending through the unitary body portion and communicating with the body cavity, the connector housing defining a connector opening communicating with the body cavity, the connector opening being adapted to receive the connector plug;

b) mounting a respective electrically conductive conductor in the at least one conductor passage such that the conductor has a contact portion disposed in the body cavity; and c) introducing an uncured sealant material into the body cavity up to a sealant fill level such that each contact portion is at least partially covered by the uncured sealant material;

d) curing the sealant material to form an environmental sealant in the body cavity; and e) wherein the unitary body portion is devoid of openings other than the at least one conductor passage up to at least the sealant fill level;

f) wherein the environmental sealant comprises a gel; and g) wherein the gel is a silicone gel and has at least one of a Voland hardness of between about 5 and 30 grams force, an elongation of at least 100%, a stress relaxation of no more than 50%, and a tack of greater than about 6 grams.

48. A method for forming a sealant-filled connector assembly for use with a connector plug, the method comprising:

a) mounting a connector housing on a substrate, the connector housing defining a body cavity and a connector opening communicating with the body cavity and adapted to receive the connector plug;

b) providing a plurality of contact portions in the body cavity; thereafter c) introducing an uncured sealant material into the body cavity through the connector opening such that the sealant material is retained in the body cavity and the body cavity is filled with the sealant material to a level sufficient to at least partially cover the contact portions; and thereafter d) curing the sealant material to form an environmental sealant in the body cavity;

e) wherein the substrate is maintained in a substantially horizontal orientation and the connector opening is disposed at an oblique angle relative to horizontal during the step of introducing the uncured sealant material.

49. The method of claim 48 wherein the step of introducing the uncured sealant material includes introducing a liquid, uncured sealant material.

50. The method of claim 48 including mounting a cover member on a body member, wherein the body cavity is defined in the body member and the connector opening is defined in the cover member.

51. The method of claim 50 wherein the connector opening is disposed at an angle of between about 40 and 60 degrees relative to horizontal during the step of introducing the uncured sealant material.

52. The method of claim 48 including applying a second sealant material to the substrate and the connector housing on the substrate to environmentally seal the connector housing.

53. The method of claim 48 wherein the connector plug is an RJ-type connector plug.

54. The method of claim 48 wherein the environmental sealant comprises a gel.

55. The method of claim 54 wherein the gel is a silicone gel and has at least one of a Voland hardness of between about 5 and 30 grams force, an elongation of at least 100%, a stress relaxation of no more than 50%, and a tack of greater than about 6 grams.

56. The method of claim 48 wherein the step of introducing the uncured sealant includes substantially fully covering the contact portions with the uncured sealant.

* * * * *